US007343724B1

(12) United States Patent
Williams et al.

(10) Patent No.: US 7,343,724 B1
(45) Date of Patent: Mar. 18, 2008

(54) SEMI-AUTOMATED CUSTOM CAPSULE DISPENSING AND ASSEMBLY MACHINE AND METHOD

(75) Inventors: Andrew Williams, Lake St. Louis, MO (US); Russell A. Nemer, St. Louis, MO (US)

(73) Assignee: Mallinckrodt Inc., Hazelwood, MO (US)

( * ) Notice: Subject to any disclaimer, the term of this patent is extended or adjusted under 35 U.S.C. 154(b) by 689 days.

(21) Appl. No.: 10/985,442

(22) Filed: Nov. 10, 2004

(51) Int. Cl.
*B65B 7/28* (2006.01)

(52) U.S. Cl. ..... 53/471; 53/281; 53/287; 53/485; 53/900

(58) Field of Classification Search ..... 53/467, 53/471, 485, 281, 287, 390, 560, 900
See application file for complete search history.

(56) References Cited

U.S. PATENT DOCUMENTS 3,552,095 A * 1/1971 Inman ..... 53/900
4,403,461 A * 9/1983 Goutard et al. ..... 53/900
4,615,165 A * 10/1986 Gamberini ..... 53/900
4,667,455 A * 5/1987 Morrow ..... 53/471
4,731,979 A * 3/1988 Yamamoto et al. ..... 53/281
4,959,943 A * 10/1990 Yamamoto et al. ..... 53/900
4,964,262 A * 10/1990 Moser et al. ..... 53/900
5,018,335 A * 5/1991 Yamamoto et al. ..... 53/281
5,101,612 A * 4/1992 Yamamoto et al. ..... 53/900
5,111,642 A * 5/1992 Chiari ..... 53/900
5,417,030 A * 5/1995 Ribani et al. ..... 53/281
6,170,226 B1 * 1/2001 Chang ..... 53/900
6,539,686 B1 * 4/2003 Trebbi ..... 53/900

FOREIGN PATENT DOCUMENTS

WO WO 03/034444 A1 4/2003

* cited by examiner

*Primary Examiner*—Louis Huynh

(57) ABSTRACT

An apparatus is used to dispense radiopharmaceuticals from a sealed source vial into capsules. The apparatus is particularly well suited for volatile radiopharmaceuticals such as radioiodine. This apparatus shields the operator from the radiopharmaceutical and also allows use of highly concentrated stock solutions.

15 Claims, 13 Drawing Sheets

SEMI-AUTOMATED CUSTOM CAPSULE DISPENSING AND ASSEMBLY MACHINE AND METHOD

FIELD OF THE INVENTION

In the field of nuclear medicine, radiopharmaceuticals are commonly prescribed for both diagnostic and therapeutic purposes. Most radiopharmaceuticals are dispensed into unit dose syringes under sterile conditions. Some radiopharmaceuticals, such as radioiodine (I-131 or I-123) are also dispensed in capsules so that they can be easily taken orally by the patient. The present invention is an apparatus and method to safely and accurately dispense liquid radiopharmaceuticals from a sealed vial into a capsule.

DESCRIPTION OF RELATED ART

Radiopharmaceuticals are commonly packaged in glass source vials sealed with a rubber septum and metal band. Radioiodine is often sold in source vials having a concentration of about 1,000 mCi/mL. In order to reduce radiation exposure during transportation and dispensing, these glass source vials are typically placed in a lead container which is referred in the industry as a pig. Radiopharmacies located across the country often keep several pigs on hand each containing a different radiopharmaceutical. When a prescription is received at a radiopharmacy, an aliquot of the radiopharmaceutical will be dispensed from the sealed glass source vial in the pig to a unit dose syringe or one or more capsules for administration to a patient.

In the past, some radiopharmaceuticals have been dispensed from a sealed source vial into capsules by hand using a syringe. Typically the dose is dispensed by hand into a single capsule. An operator grasps the lead pig housing a glass source vial containing a radiopharmaceutical in one hand and grasps a syringe with a needle in the other hand. The pig may have an opening or port above the rubber septum of the source vial. The operator inserts the needle through the port in the pig, punctures the rubber septum with the needle and withdraws an aliquot of the radiopharmaceutical into the syringe. The proximity of the hands to the radiopharmaceutical, especially in high concentrations, results in a rapid radiation exposure to the extremities of the operator. After transfer to the syringe, the activity level of the radiopharmaceutical in the syringe is measured using a dose calibrator. Corrections may be made for radioactive decay. An aliquot of the radiopharmaceutical is transferred from the syringe to one or more capsule bottoms filled with an excipient. A capsule top is placed on each capsule bottom and the completed capsules are placed in a transportation pig(s) for delivery to a hospital. At the medical facility, the capsules containing the radiopharmaceutical are orally administered to the patient for therapeutic or diagnostic purposes.

This manual prior art dispensing process is time consuming and subjects the operator to high extremity exposure rates from the radiopharmaceutical. There is a need for a better method and apparatus to dispense radiopharmaceuticals to reduce extremity exposure to occupational workers.

As an alternative to dispensing radioiodine by hand, some manufactures prefill capsules that are delivered to a medical facility or a radiopharmacy. These prefilled capsules are kept on hand until a need arises. This often requires use of larger and often multiple capsules to dispense the prescribed dose. It is common to require 2 or 3 prefilled capsules to deliver a single dose. Some patients do not tolerate multiple capsules or the increased amount of excipient caused by several capsules. So there is a dilemma. Prefilled capsules reduce extremity exposure but often require several capsules to deliver a dose. Manual filing of a single capsule with a stork solution having a high concentration (1,000 mCi/mL) results in extremity exposure to the radiopharmacist. There is a need for a method and apparatus that will allow dispensing into a single capsule and reduce extremity exposure to the radiopharmacist.

One attempt to solve the aforementioned difficulties is disclosed in International Application Number PCT/US02/32812, now publication number WO03/034444 entitled "Radiopharmaceutical Capsule Dispensing System" assigned to Mallinckrodt Inc., the assignee of the present invention. Unfortunately, the apparatus disclosed in the aforementioned publication was difficult to operate and sometimes resulted in more wasted product than anticipated. There is still a need for an apparatus and method that can prevent the escape of vapors from a source vial of a volatile radiopharmaceutical and provide safety and accuracy during the dispensing process.

SUMMARY OF THE INVENTION

The present invention is a method and apparatus for accurate dispensing of radiopharmaceuticals, including but not limited to highly volatile compounds such as radioiodine, from a sealed source vial into capsules which reduces extremity exposure to occupational workers and facilitates use of stock solutions with high concentrations. This capsule dispensing system is contained in a portable housing weighing less than 400 pounds.

The present invention allows dispensing of stock solutions of radioiodine having a concentration of 1,000 mCi/mL or more into a single capsule per dose. If properly used, this invention may reduce extremity exposure to a radiopharmacist by about 90% or more as compared to conventional manual filling techniques with a stock solution of 1,000 mCi/mL.

When a prescription for a radiopharmaceutical is received, a pump transfers a calculated volume of the radiopharmaceutical in accordance with this prescription from the sealed source vial into the capsule bottom. (The calculation accounts for a radioactive decay correction.) The capsule top is placed on the capsule bottom and the completed capsule is placed in a transportation pig. The top is screwed on the transportation pig and the completed capsule is ready for shipment to a medical facility for oral administration to a patient.

DETAILED DESCRIPTION OF THE INVENTION

Figure 1:
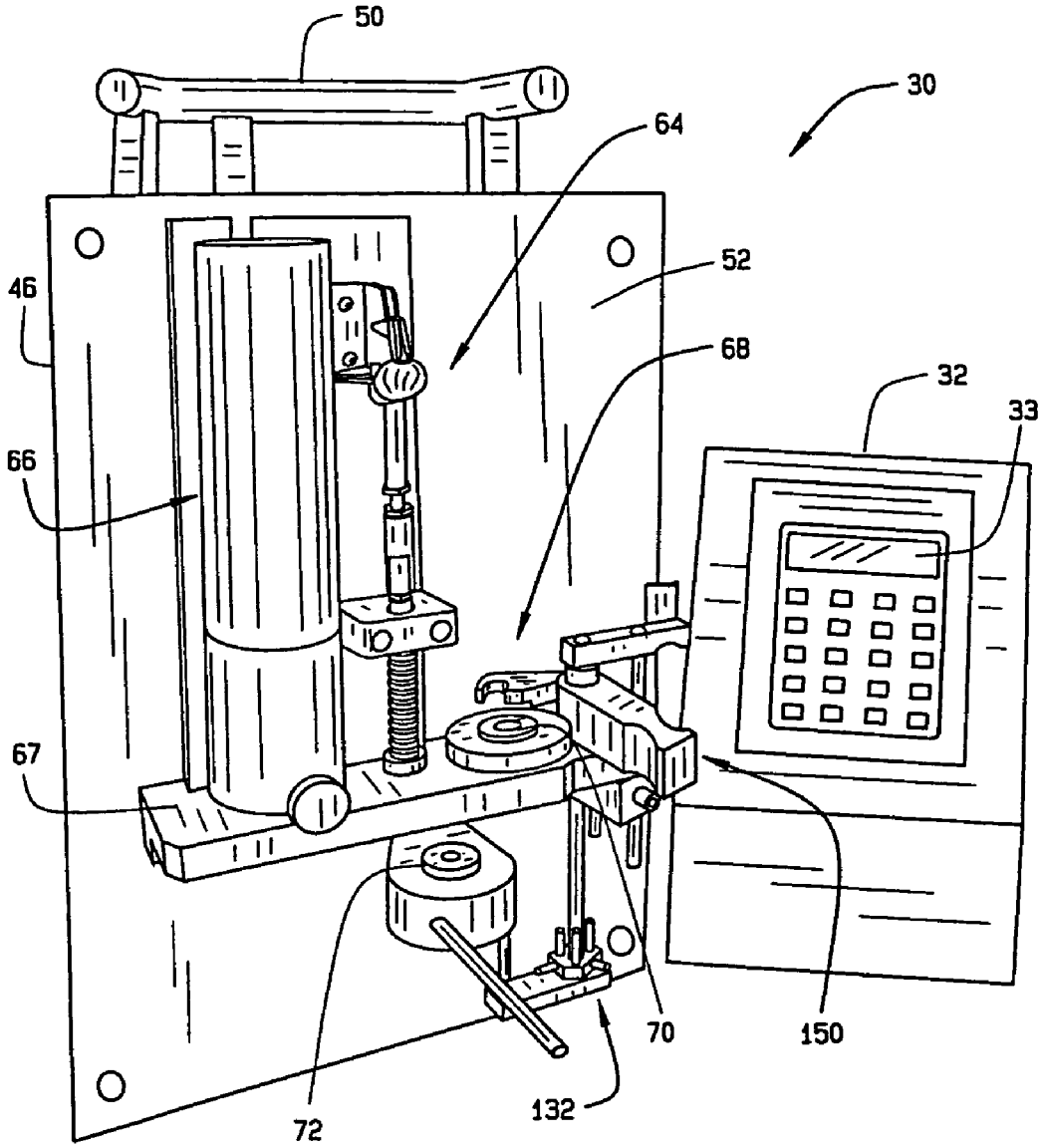
FIG. 1 is a partial perspective view of the elevation of the semi-automated custom capsule dispensing machine including an input device.
Figure 2:
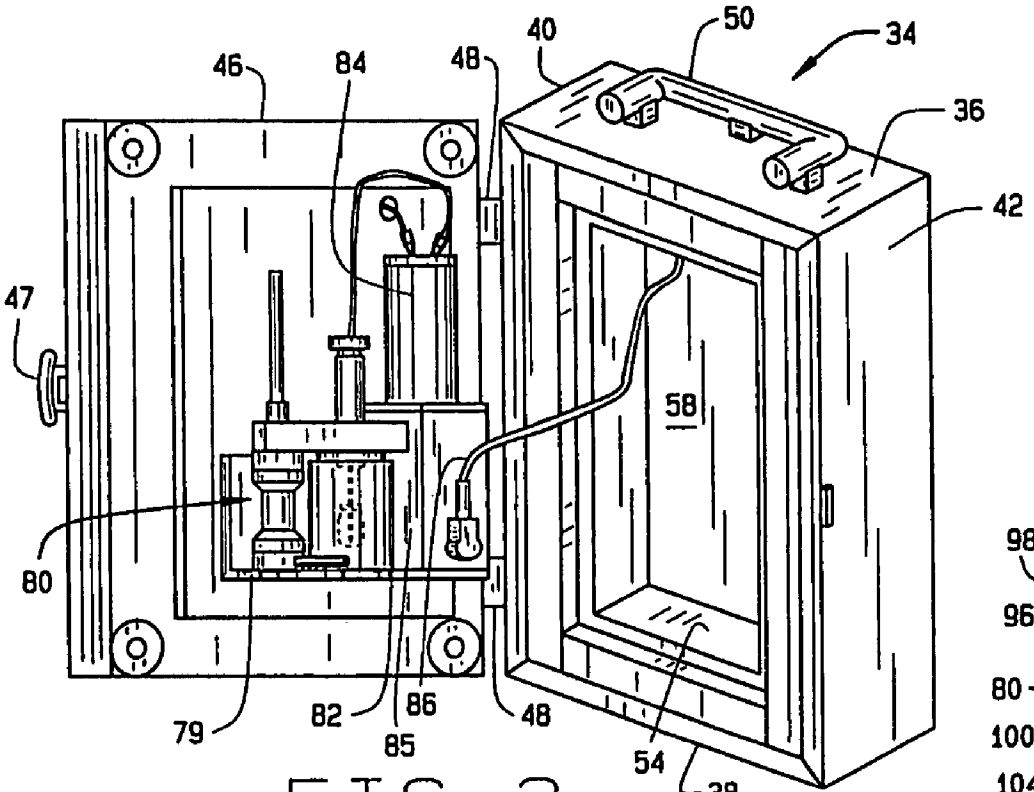
FIG. 2 is a perspective view of the semi-automated custom capsule dispensing machine with the door open showing the interior components and the interior of the housing.
Figure 25:
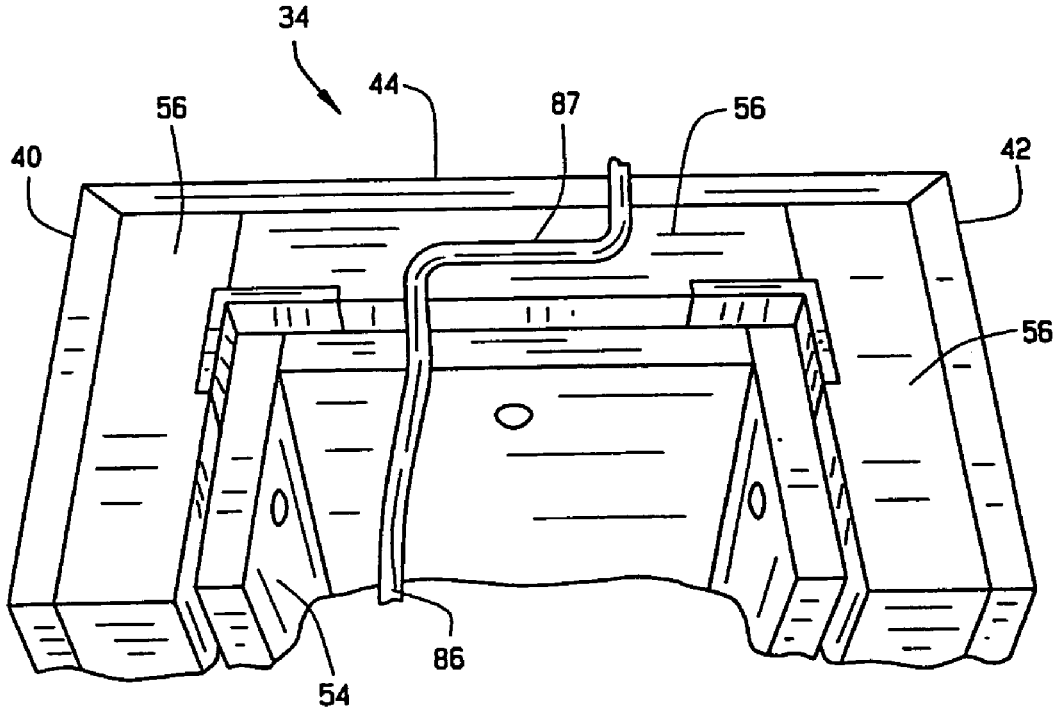
FIG. 25 is a partial view of the housing of the custom capsule dispensing machine with the top wall removed to show the z-shaped pathway of the conductors through the back wall of the housing.

Referring to FIGS. 1, 2 and 25, the semi-automated custom capsule dispensing system is generally identified by the numeral 30 and will hereinafter be referred to as the "Dispensing System 30". The Dispensing System 30 includes an input device 32. The input device can be any number of different devices including, but not limited to a key pad as shown, or a key board or touch screen not shown, or any number of other input devices well known to those skilled in the art. The input device may also include a display device 33. The display device can be any number of different devices including, but not limited to a liquid crystal display as shown, or a monitor or plasma screen or any number of other display devices well known to those skilled in the art. Conductors run from the input device 32 through the housing 34 as better seen in FIG. 23. The conductors from the input device are connected to an actuator 85 that controls the pump 84. Conductors run from the actuator through the housing 34 to a power source, not shown. Conventional 110 v, 60 Hz, power can be used to operate the Dispensing System 30.

The Dispensing System 30 includes a housing 34 with a top wall 36, bottom wall 38, left side wall 40, right side wall 42, back wall 44 and front wall 46, which in this case is a door. The door 46 is connected the left side wall 40 with hinges 48 and to the right side wall 42 with a latch 47. A handle 50 is connected to the top wall 36. The housing defines an outer surface 52 and an inner surface 54. Shielding materials 56, such as lead is located between the outer surface 52 and the inner surface 54. The purpose of the shielding materials is to reduce the amount of radiation exposure to an operator from the radiopharmaceutical. Other shielding materials may also be suitable for this application.

The shielding materials define a chamber 58 inside the housing. Interior components of the Dispensing System 30 are located inside the chamber 58 of the housing. Exterior components of the Dispensing System 30 are located outside the housing. The exterior components include the toggle assembly, generally identified by the numeral 64, the delivery needle assembly, generally identified by the numeral 66 and the assembly system, generally identified by the numeral 68. The assembly system includes the slide subassembly 132 and the capsule stop subassembly 150, better seen in subsequent figures. A shelf 67 is attached to the door 46 and is used to mount or partially secure the toggle assembly, the delivery needle assembly and the assembly system. A removable upper capsule insert 70 and a removable bottom capsule insert 72 are placed in the assembly system 68. A capsule bottom 74 is placed in the removable capsule bottom insert and a capsule cap 76 is placed in the removable bottom capsule insert. (The capsule bottom, which contains a suitable excipient and the capsule cap, which does not contain excipient are better seen in FIGS. 14-16.) The purpose of the Dispensing System 30 is dispense a unit dose of a liquid radiopharmaceutical into the capsule bottom and to assemble the capsule bottom and capsule cap into a completed capsule 78 for administration to a patient, while reducing the radiation exposure to the operator. (The completed capsule is better seen in FIGS. 17 and 18.)

The interior components include an interior mounting plate 79, a pick-up needle assembly 80, a safe 82, a pump 84, which includes an actuator 85 and conductors 86. A suitable pump is the model millGAT produced by Global FIA, Inc of Fox Island, Wash. although other pumps may also be suitable in this application. A suitable actuator 85 is the model CP-DSM produced by Valco Instruments Co., Inc. In FIG. 2, the door 46 is shown in the open position to better reveal the interior components and the chamber 58. During operation of the Dispensing System 30, the door 46 is open only when the radiopharmaceutical is being replenished as better seen in the next figure. During day to day operation of the Dispensing System, the door 46 is closed and the interior components are positioned inside the chamber 58 to reduce radiation exposure from the radiopharmaceutical to the operator.

Figure 3:
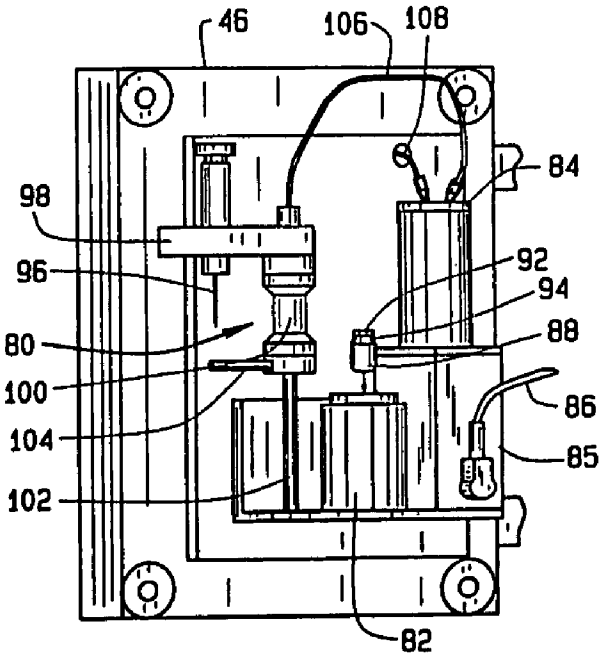
FIG. 3 is an elevation view of the interior components of the semi-automated custom capsule dispensing machine with the pick-up needle assembly in the open position and a source vial of stock solution above the safe.

FIG. 3 is an elevation view of the interior components of the Dispensing System with the pick-up needle assembly 80 in the clear position and a source vial 88 of radiopharmaceutical 90 above the safe 82. The source vial 88 is shown in a position above the safe 82. The source vial is in this position when it is inserted or removed from the safe. The source vial has a rubber septum 92 and a metal band 94, which contain the radiopharmaceutical in the source vial. Containment is important with volatile radiopharmaceuticals like radioiodine. The present Dispensing System keeps the radiopharmaceutical sealed in the source vial, thus preventing radioactive fumes from escaping. This feature distinguishes the present invention from some prior art systems that required elaborate filtering systems to contain radioactive fumes from volatile radiopharmaceuticals.

The pick-up needle assembly 80 includes a pick-up needle 96, a pick-up needle arm 98, a sleeve 100, a pick-up needle assembly guide rod and a pick-up needle assembly handle 104. The pick-up needle assembly and the pick-up needle move from an clear position shown in FIG. 3 to an inserted position shown in FIG. 2. The sleeve rides up and down the pick-up needle guide rod from the upper position the lower position. As the sleeve rides up and down, the arm and the needle are carried from the clear to the inserted position. While moving from the clear position to the inserted position, the pick-up needle 96 penetrates the rubber septum 92 and makes contact with the radiopharmaceutical in the bottom of the source vial 88. In one embodiment, not shown, the pick-up needle has inlet holes on the side, not the end, like a conventional needle. Uptake of the radiopharmaceutical through a conventional needle could be obstructed by contact with the bottom of the source vial.

The pick-up needle assembly and the pick-up needle also move from a clear position shown in FIG. 3 to an inserted position shown in FIG. 2. These positions enable the source vial of radiopharmaceutical to be inserted into the safe and be replaced as needed. In order to insert a source vial into the safe, the pick-up assembly and pick-up needle are moved to the upper clear position as shown in FIG. 3. The lid of the safe, not shown, is removed. A fresh source vial of radiopharmaceutical is inserted in the safe and the safe top is replaced on the safe. The operator grasps the finger 104 and rotates the sleeve 100, the pick-up needle arm 98 and the pick-up needle from the clear to the engage position and from the upper to the lower position. While moving from the clear to the inserted position, the pick-up needle penetrates the rubber septum and comes into contact with the radiopharmaceutical in the source vial. The pick-up needle assembly and the pick-up needle are shown in the lower engaged position in FIG. 2.

To replace the source vial, the process is reversed. The pick-up needle assembly and the pick-up needle are moved from the lower to the upper position, withdrawing the needle from the rubber septum in the source vial. The pick-up needle assembly and the pick-up needle are then moved from the inserted to the clear position as shown in FIG. 3. The lid of the safe if taken off the safe and the old source vial is removed. A fresh source vial is put in the safe and the process is repeated. In many radiopharmacies, source vial replacement only occurs once per week.

A first conduit 106 connects the pick-up needle 96 with the pump 84. A second conduit 108 connects the pump with the delivery needle 110 better seen in FIGS. 11-13. The radiopharmaceutical 90 flows from the source vial 88, through the first conduit 106, to the pump 84, through the second conduit 108 to the delivery needle 110 and into the capsule bottom 74, also better seen in FIGS. 11-13.

Figure 4:
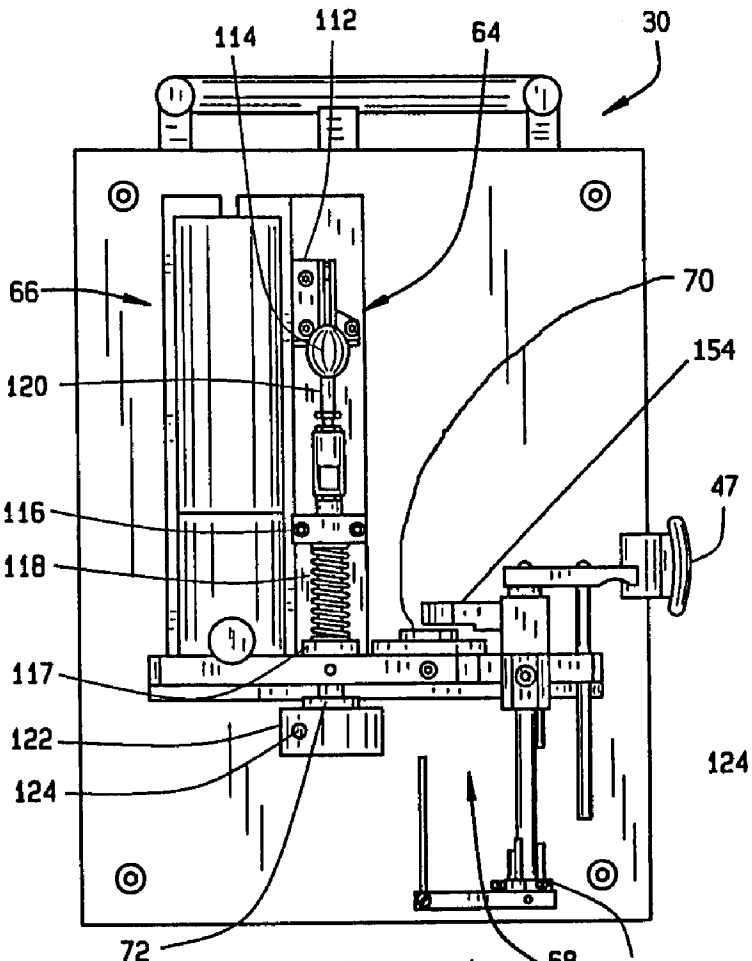
FIG. 4 is an elevation view of the semi-automated custom capsule dispensing machine with the exterior components in the start position.

FIG. 4 is an elevation view of the Dispensing System 30 with the exterior components in the start position. The toggle assembly 64 includes a toggle frame 112, a toggle arm 114, a guide frame 116, a spring stop 117, a spring 118, a connecting rod 120, a pivot arm 122 and a pivot arm handle 124. The spring 118 surrounds the rod 120 and is captured between the guide frame 116 and the spring stop 117, mounted on the rod 120. The removable bottom capsule insert 72, is carried by the pivot arm 122, the purpose of the toggle assembly is to move the bottom capsule insert and the pivot arm from a lower position shown in FIG. 4 to the upper position shown in FIG. 6. This movement for the lower to the upper position and back is accomplished by actuation of the toggle arm 114 which is pivot mounted in the toggle frame 112. Moving the toggle arm carries the connecting rod and the pivot arm from the lower to the upper position and back. The pivot arm handle 124 is grasped by the operator to move the pivot arm 122 from the start (6:00) position, to the dispense (9:00) position, and then to the assemble (3:00) position.

Figure 5:
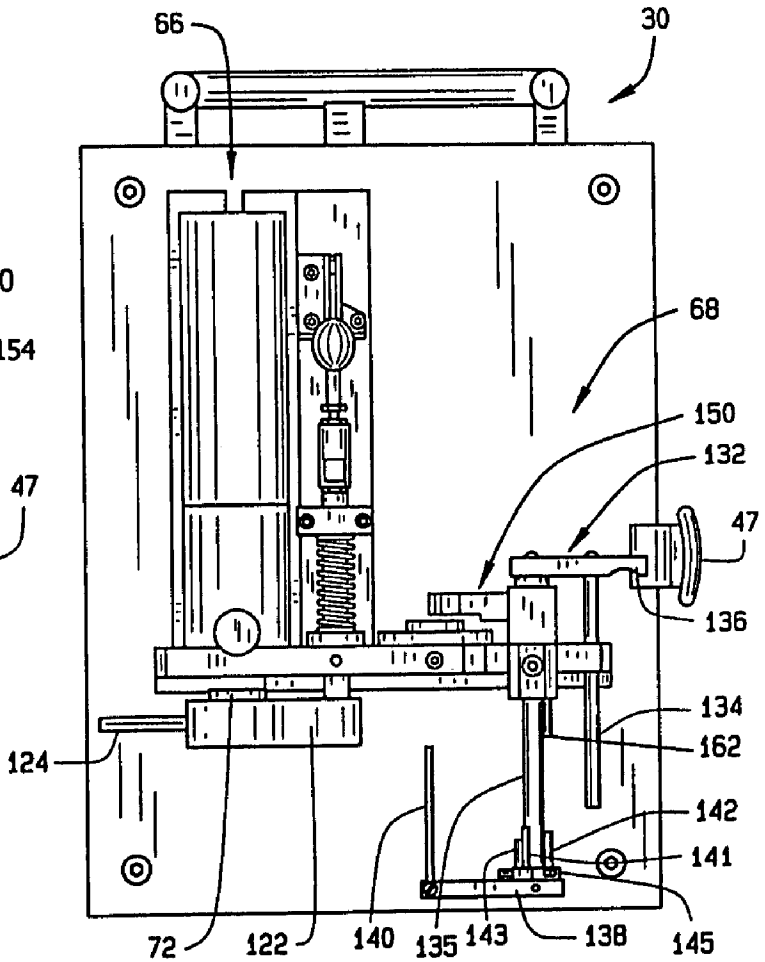
FIG. 5 is an elevation view of the semi-automated custom capsule dispensing machine of FIG. 4 with the pivot arm in the fill position and the toggle assembly in the lower position.
Figure 7:
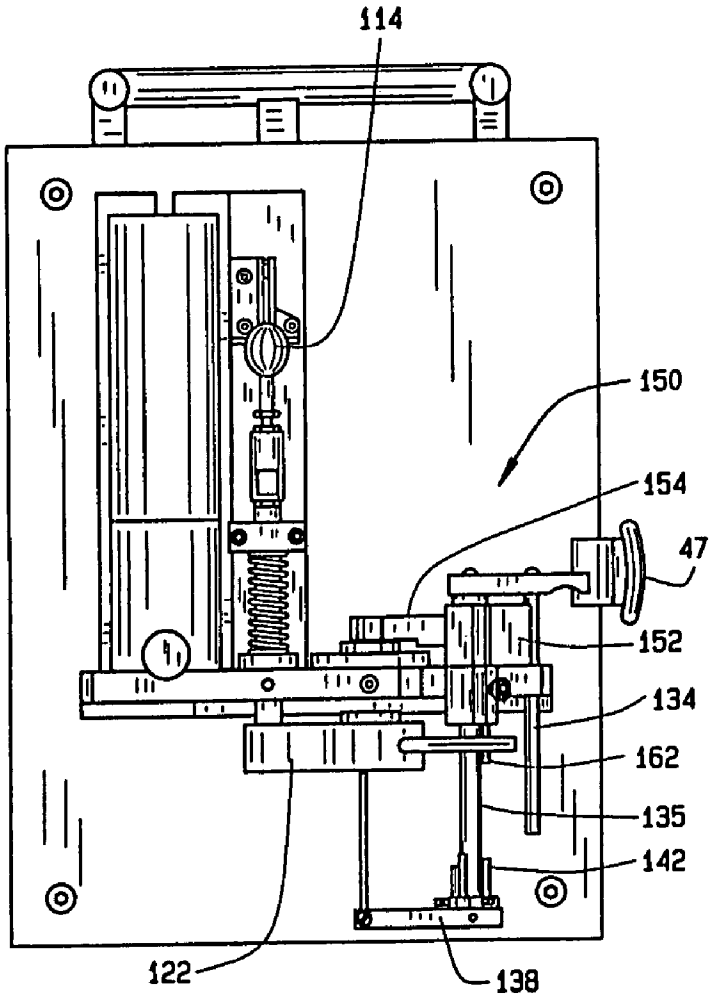
FIG. 7 is an elevation view of the semi-automated custom capsule dispensing machine of FIG. 4 with the pivot arm in the assemble position, and the toggle assembly in the lower position.

The pivot arm can be rotated by the pivot arm handle 124 from the start position shown in FIG. 4 to the dispense position shown in FIG. 5 to the assemble position shown in FIG. 7. FIGS. 4-10 portray the operational sequence of the Dispensing System 30 for dispensing a dose 126 of radiopharmaceutical and assembly of a completed capsule 78, best seen in FIG. 18. Each step of the sequence will be described below.

In FIG. 4, the pivot arm 122 (which is a component of the assembly system 68) is in the start or 6:00 position with the pivot arm handle pointing towards the operator. Because different sizes of capsules can be used, the Dispensing System has a set 128, not shown, of removable upper capsule inserts and a set 130, not shown, of removable bottom capsule inserts in different sizes to accommodate the different sizes of capsule. After reviewing the prescription for a unit dose, the operator decides on the size and number of capsule(s) needed and selects an appropriate upper capsule inset and an complementary sized bottom capsule insert from the sets 128 and 130. For purposes of this example a medium sized capsule has been selected for assembly. The bottom capsule insert is placed in the pivot arm and the upper capsule insert in placed in the assembly system. A capsule bottom 74 is placed in the removable bottom capsule insert which is carried by the pivot arm, and a capsule cap 76 is placed in the removable upper capsule insert in the assembly system. The toggle assembly is in the lower position. For illustrative purposes, the claw 154 is shown separated from the removable upper capsule insert 70 in FIGS. 4-6; however in actuality the claw 154 contacts the removable upper capsule insert 70 as better seen in FIGS. 14-16. The function to the claw and the upper capsule insert will be discussed in greater detail below.

FIG. 5 is an elevation view of the Dispensing System 30 of FIG. 4 except the pivot arm in now the fill position (9:00) under the delivery needle assembly 66. The toggle assembly in still in the lower position as shown in the preceding figure. The relative position of the capsule bottom and the delivery needle 110 are better seen in FIG. 11. The assembly system 68 includes a slide subassembly 132 and a capsule stop subassembly 150.

The slide subassembly 132 includes a slide guide rod 134, a slide handle 136, a slide arm 138, a slide assembly/ejection rod 140, and a plurality of height assembly slide stops, 141, 142 and 143 rotateably mounted on a carousel 145. A set 144, not shown, of different sized removable slide stops allows the operator to select the appropriate size for the capsule being assembled.

The operator should rotate the carousel 145 to the proper location depending upon the capsule size to be used. Capsules come in various sizes including: 000, 00, 0, 1, 2, 3, 4, and 5. For smaller capsules (like a number 5), the tallest height assembly slide stop, 141 will be used. For medium sized capsules, the medium height assembly slide stop 142 will be used. (A medium sized capsule (number 3) is being assembled in this example.) For larger sized capsules (000), the small height assembly slide stop 143 will be used. The height assembly slide stop pins, 141, 142 and 143 prevent the slide subassembly 132 from being extended upward which could crush the capsule. The height assembly slide stops permit the user to repeatably and reliably assembly the capsule cap and the capsule bottom to the proper depth depending on the size of the capsule being used.

Figure 10:
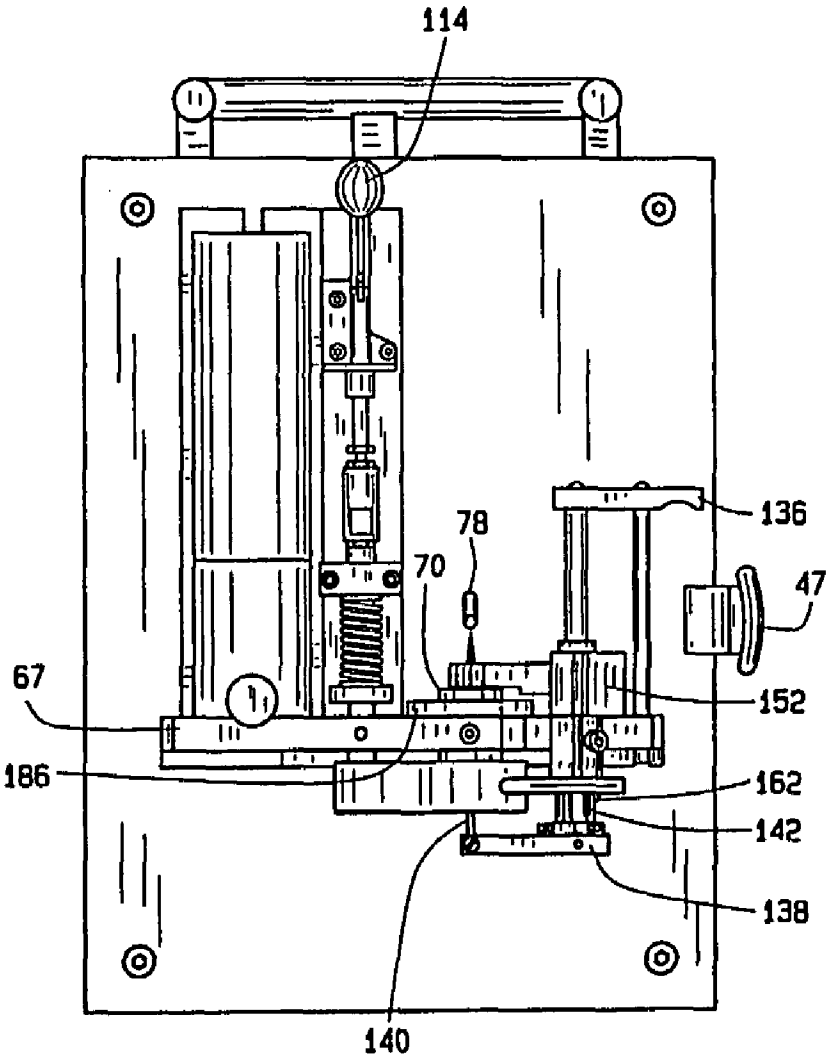
FIG. 10 is an elevation view of the semi-automated custom capsule dispensing machine of FIG. 8 showing the completed capsule being ejected from the machine.
Figure 19:
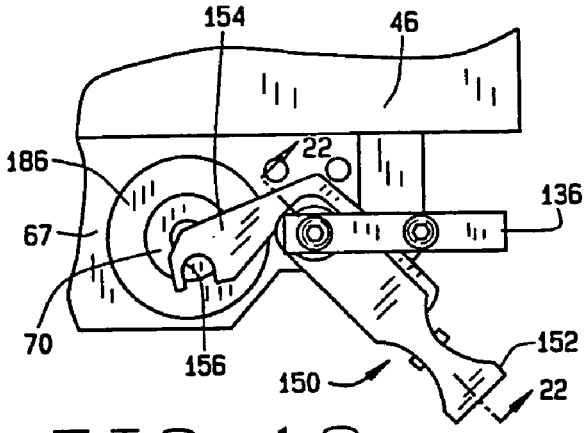
FIG. 19 is a top view of the capsule stop in the closed position as shown in FIGS. 14-16, above.
Figure 20:
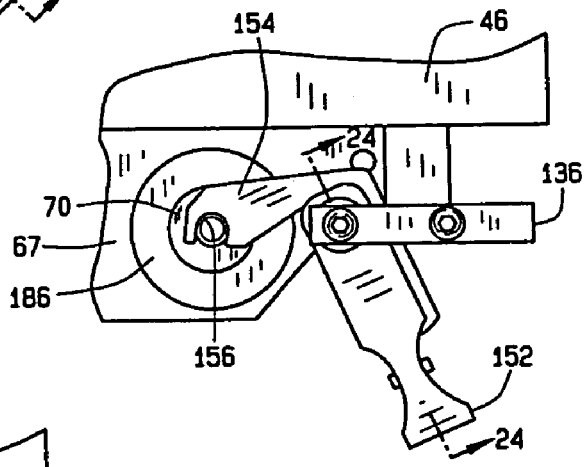
FIG. 20 is a top view of the capsule stop in the open position as shown in FIGS. 17 and 18 above.
Figure 21:
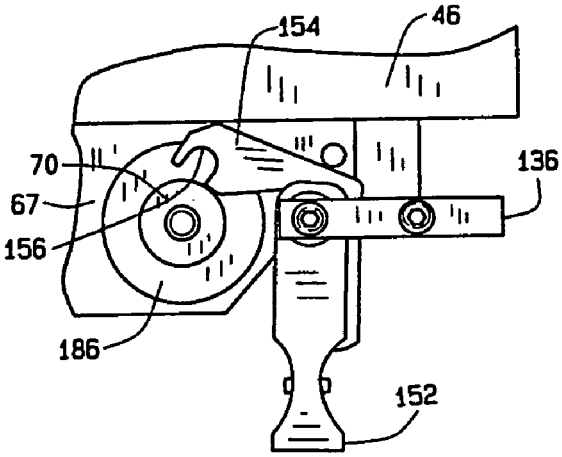
FIG. 21 is a top view of the capsule stop in the tool change out position allowing the upper capsule insert to be removed from the assembly system.

The capsule stop subassembly is also a part of the assembly system 68. The capsule stop subassembly has three positions (tool change out, closed position and open position) better seen if FIGS. 19-21. In FIGS. 4 and 21, the capsule stop subassembly is in the tool change out position so an appropriately sized removable upper capsule inset can be placed in the tooling. In FIG. 5 and FIG. 19, the capsule stop subassembly is in the closed position to hold the capsule cap 76 and the removable upper capsule insert in the tooling during assembly of the capsule. In FIG. 10 and FIG. 20, the capsule stop subassembly is the open position to allow the completed capsule 78 to be ejected from the Dispensing System 30.

Figure 6:
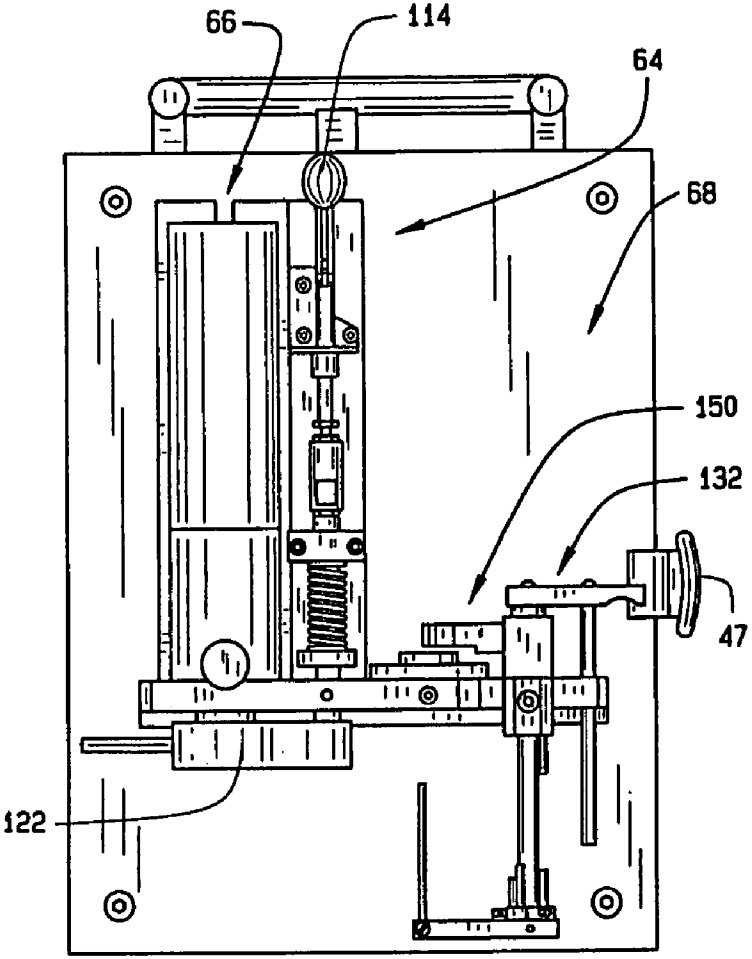
FIG. 6 is an elevation view of the semi-automated custom capsule dispensing machine of FIG. 4 with the pivot arm in the fill position and the toggle assembly in the upper position. A dose of radiopharmaceutical is dispensed into the capsule bottom at this position.

FIG. 6 is an elevation view of the Dispensing System 30 of FIG. 4 with the pivot arm 122 in the fill position underneath the delivery needle assembly 66. The toggle arm has been actuated moving the toggle assembly 64 from the lower position of FIG. 5 to the upper position as shown in FIG. 6. This moves the capsule bottom closer to the delivery needle 110, as better seen in FIG. 12. The position of the assembly system 68, the slide subassembly 132 and the capsule stop subassembly 150 have not changed from FIG. 5 to FIG. 6.

The operator inputs into the input device 32, shown in FIG. 1, the volume of liquid radiopharmaceutical to be dispensed. The desired volume to be dispensed from the source vial 88 onto the capsule excipient 146 in the capsule bottom 74 is calculated based upon the quantity of activity requested by the physician's prescription order and the radioiodine source strength at the time the capsule is made. The operator actuates the input device 32 to dispense the dose and signals are sent from the input device 32 to the actuator 85, shown in FIGS. 2 and 3. The pump 84 then pumps the dose of liquid radiopharmaceutical from the source vial 88 through the delivery needle into the excipient in the capsule bottom held in the removable bottom capsule insert which is carried by the pivot arm.

A droplet of liquid radiopharmaceutical will sometimes hang on the tip 111 of the delivery needle 110 after the pump has been actuated to dispense the dose of radiopharmaceutical. To ensure that the lingering droplet of liquid radiopharmaceutical falls in the capsule bottom a push pin 148 is positioned in the delivery needle assembly 66 to deflect the delivery needle 110 causing the lingering droplet to move into the capsule bottom, as shown in greater detail in FIGS. 11-13. After the pump has dispensed the dose, the push pin is pressed inward (one to several times) in order to deflect the needle so that it touches the capsule wall as shown in FIG. 13. This motion is needed in order to remove the last droplet from the delivery needle 110. Thereafter, the toggle arm 114 of the toggle assembly 64 is moved to the lower position as previously shown in FIG. 4, lowering the pivot arm 122. The operator then grasps the pivot arm finger and moves the pivot arm to the assemble (3:00) position as shown in FIG. 7.

FIG. 7 is an elevation view of the Dispensing System 30 of FIG. 4 with the pivot arm 122 in the assemble or 3:00 position, and the toggle assembly 64 in the lower position. The capsule stop subassembly 150 is in the closed position. The capsule stop subassembly 150, better seen in section in FIGS. 22-24, includes a capsule stop subassembly handle 152, a claw 154, a u-shaped recess 156 in the claw, a slide stop rod 162, a position pin 160, a position pin spring 161, an upper bushing 164, a lower bushing 166, and a sleeve 168. The capsule stop subassembly handle is rotatably mounted on the slide rod 135. The capsule stop subassembly handle 152 and the claw 154 are integrally connected and move in tandem.

Figure 14:
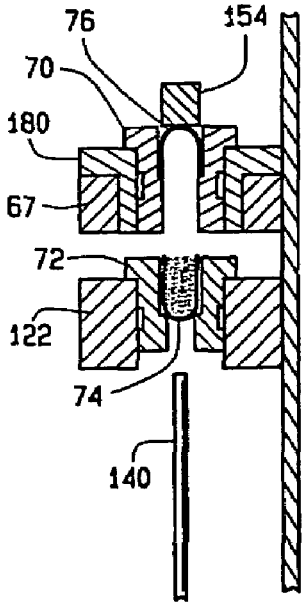
FIG. 14 is an enlarged section view of the capsule bottom and capsule cap as positioned in the semi-automated custom capsule dispensing machine of FIG. 7. In this view the capsule stop is in the closed position as shown in FIG. 19, below.
Figure 15:
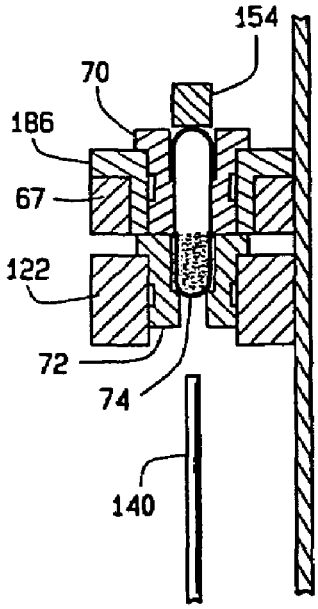
FIG. 15 is an enlarged section view of the capsule bottom and capsule cap as positioned in the semi-automated custom capsule dispensing machine of FIG. 8. In this view the capsule stop is in the closed position as shown in FIG. 19, below.
Figure 16:
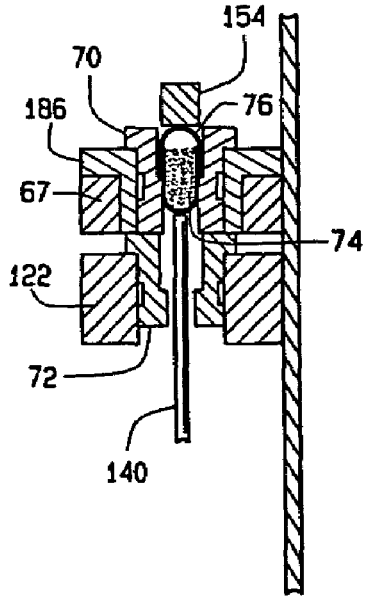
FIG. 16 is an enlarged section view of the capsule bottom and capsule cap as positioned in the semi-automated custom capsule dispensing machine of FIG. 9. In this view, the capsule stop is in the closed position as shown in FIG. 19, below.

The capsule stop subassembly handle 152 and the claw can be moved by the operator to three different positions better seen in FIGS. 19-21. The first position, as shown in FIGS. 7 and 19 is referred to as the closed position and is also shown in FIGS. 14-16. In the closed position, the claw 154 contacts the capsule cap and holds it in place during the assembly process. The second position of the capsule stop subassembly handle 152 and the integral claw is referred to as the open position and is the position shown in FIG. 10 and FIGS. 17-18. In the open position, the u-shaped recess 156 in the claw 154 is clear of the capsule cap and the completed capsule may be ejected from the assembly system. The third position of the capsule stop subassembly handle 152 and the integral claw is referred to as the tool change out position, better seen in FIG. 21. In the tool change out position, the operator can remove and replace the removable upper capsule insert to accommodate capsule caps of different sizes. This is also the position where the operator inserts the capsule cap into the removable upper capsule insert. Before moving to the next step, the operator moves the toggle arm 114 to the upper position as shown in the next figure.

Figure 8:
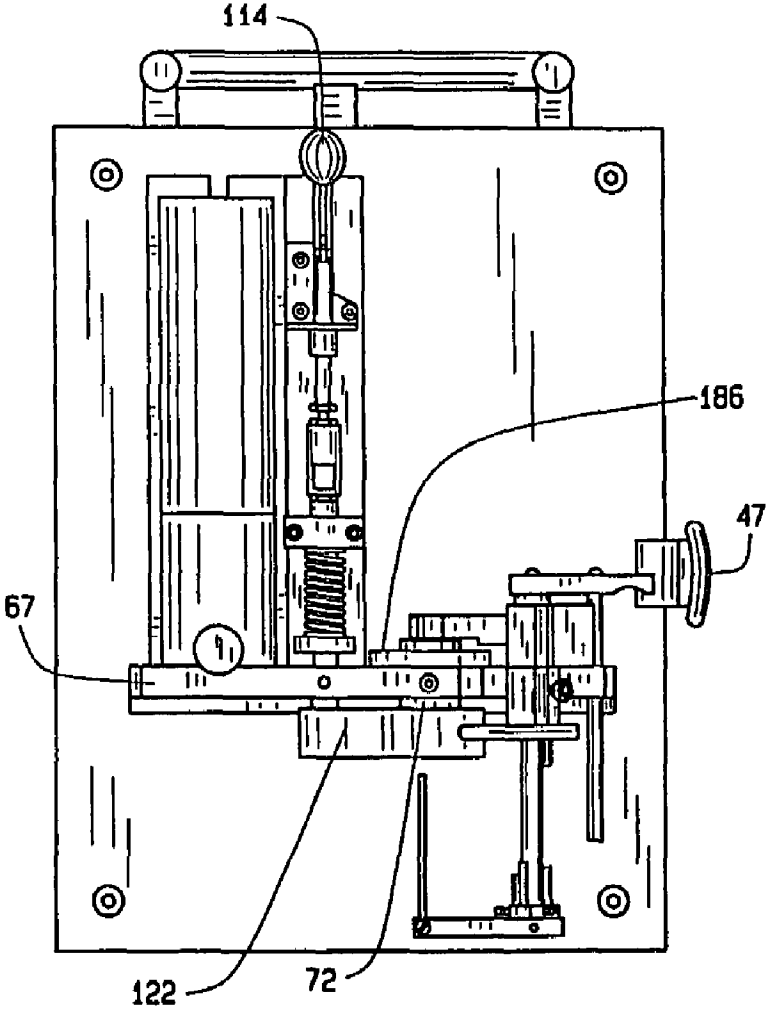
FIG. 8 is an elevation view of the semi-automated custom capsule dispensing machine of FIG. 4 with the pivot arm in the assemble position, and the toggle assembly in the upper position.

FIG. 8 is an elevation view of the Dispensing System 30 of FIG. 4 with the pivot arm in the assemble (3:00) position, and the toggle assembly 64 in the upper position. The capsule stop subassembly handle 152 and the integral claw are in the closed position as shown in FIG. 19 to hold the capsule cap in the removable upper capsule insert during the assembly process which will be described in the following figures.

Figure 9:
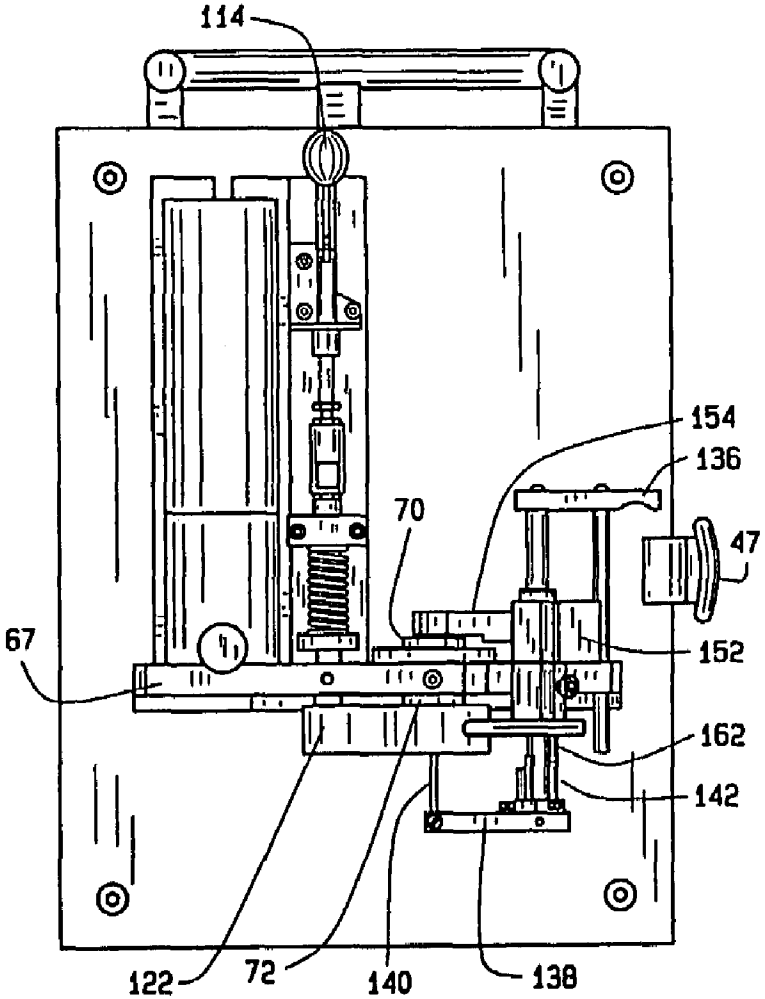
FIG. 9 is an elevation view of the semi-automated custom capsule dispensing machine of FIG. 8 with the assembly slide in the upper position.

FIG. 9 is an elevation view of the Dispensing System 30 of FIG. 8 with the assembly slide 136 in the upper position. The assembly/eject rod is moved upward as the assembly slide 136 is moved upward to complete the assembly of the capsule cap and the capsule bottom as better seen in section view in FIG. 16. A removable height assembly stop 142 engages the slide stop rod 162 to prevent crushing of the capsule cap and the capsule bottom. The height of the removable height assembly stop is selected to complement the size of the capsule for a particular dose. Several other removable height assembly stops of different heights, 141 and 143 are positioned on a rotating carousel 145, to facilitate reconfiguration of the Dispensing System 30, when different sized capsules are required. The Dispensing System comes with a set 144, not shown of removable height stops to facilitate production of capsules of different sizes. After the completed capsule 78 has been assembled, the slide assembly is returned to the lower position.

Figure 18:
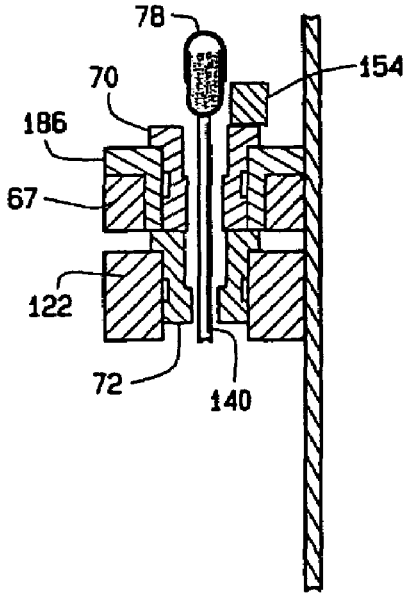
FIG. 18 is an enlarged section view of the completed capsule being ejected from the custom capsule dispensing machine of FIG. 10. In this view, the capsule stop is in the open position as shown in FIG. 20, below.

FIG. 10 is an elevation view of the Dispensing System 30 of FIG. 8. In order to eject the completed capsule 78, the capsule stop subassembly handle 152 and the integral claw must be moved to the open position, better seen in FIG. 20. In the open position, the u-shaped recess of the claw is positioned above the completed capsule. Then, the slide assembly is moved to the upper position as shown in FIG. 10 to eject the completed capsule 78 through the u-shaped recess of the claw. A section view of the ejection of the completed capsule is shown in FIG. 18.

Figure 11:
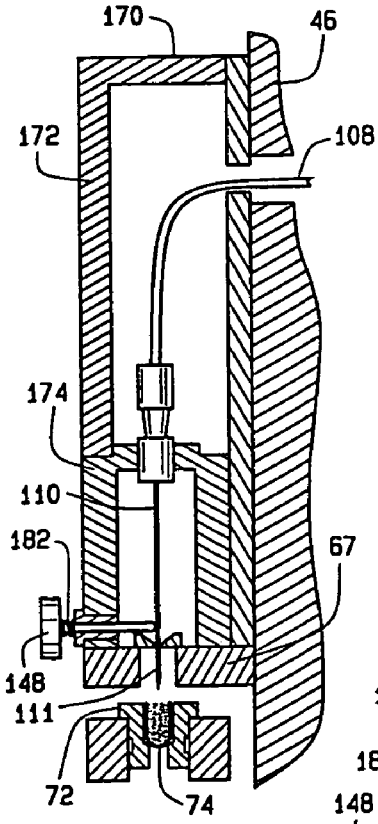
FIG. 11 is a section view of the delivery needle assembly with the pivot arm and capsule bottom in the same position as shown in FIG. 5.
Figure 12:
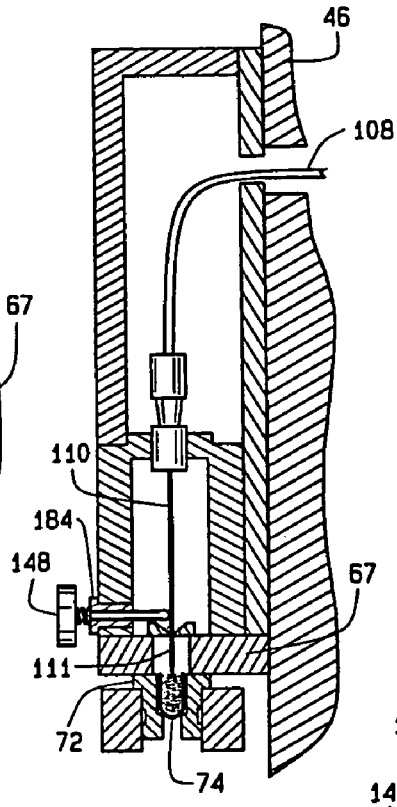
FIG. 12 is a section view of the delivery needle assembly with the pivot arm and the capsule bottom in the same position as shown in FIG. 6.
Figure 13:
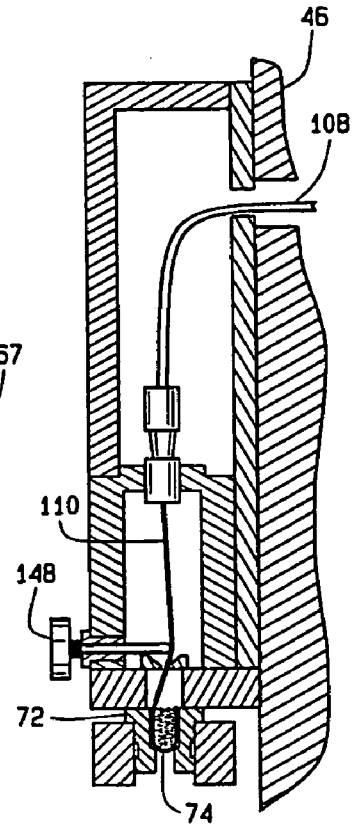
FIG. 13 is a section view of the delivery needle assembly with the push pin deflecting the delivery needle to cause a final drop of radiopharmaceutical to fall from the delivery needle into the capsule bottom.

FIGS. 11-13 are section views of the delivery needle assembly 66 including the cowling assembly 170 which includes the upper portion of the cowling 172 and the lower portion 174 which sit on the shelf 67. In order to reduce exposure to operator, certain parts of the Delivery System 30 can be formed of tungsten instead of lead. Tungsten has better shielding properties than lead. The following components can be fabricated from tungsten: the upper portion of the cowling 172, the lower portion of the cowling 174, the source vial safe, 82 and the source vial lid, the push pin 148, the pivot arm 122, the removable upper capsule insert 70, the removable lower capsule insert 72 and the jig 186.

FIG. 11 shows the pivot arm 122, the removable lower capsule insert 72 and the capsule bottom 74 below the delivery needle assembly 66 in the same position as FIG. 5. In FIG. 11 and FIG. 5, the toggle assembly 64 is in the lower position. FIG. 12 shows the toggle assembly 64 in the upper position as seen in FIG. 6. The radiopharmaceutical is dispensed into the capsule bottom 74 in FIG. 12. FIG. 13 shows the toggle assembly 64 in the upper position as seen in FIG. 6. In FIG. 13, the push pin 148 is pushed inward to deflect the delivery needle 110 into contact with the capsule bottom, as shown. The contact with the capsule bottom causes the last droplet of radiopharmaceutical to move into the capsule bottom, thus completing the dispensing of the radiopharmaceutical.

Figure 17:
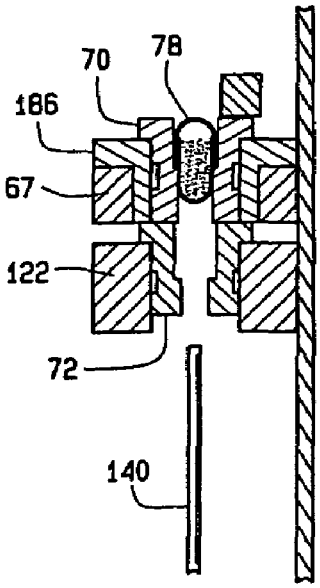
FIG. 17 is an enlarged section view of the completed capsule as positioned in the semi-automated custom capsule dispensing machine. In this view, the capsule stop is in the open position as shown in FIG. 20, below.

FIGS. 14-18 are section views of the assembly and ejection process of the capsule. FIG. 14 is a section view of the components shown in FIG. 5. The capsule cap 76 is positioned above the capsule bottom 74 and the toggle assembly 64 is in the lower position. FIG. 15 is a section view of the components shown in FIG. 6. The toggle assembly 64 has been shifted to the upper position. FIG. 16 is a section view of the components shown in FIG. 9. The assembly/eject rod 140 has been raised to assemble the capsule cap and the capsule bottom. FIG. 16 is a section view of the claw and adjustable hold down pin in the open position. FIG. 17 is a section view of the components shown in FIG. 10. In this view, the completed capsule 78 is ejected from the Dispensing System 30.

FIGS. 19-21 are plan views of the capsule stop subassembly 150 including the claw 154 and the capsule stop subassembly handle 152. In FIG. 19, the capsule stop subassembly is in the closed position holding the capsule cap in the removable upper capsule insert as better seen in section view in FIG. 14. In FIG. 20, the capsule stop subassembly is in the open position allowing the completed capsule to be ejected from the Dispensing System as better seen in section view in FIG. 18. In FIG. 21, the capsule stop subassembly is in the tool change out position allowing the removable upper capsule insert to be removed from the jig so another insert of a different size can be placed in the jig.

Figure 22:
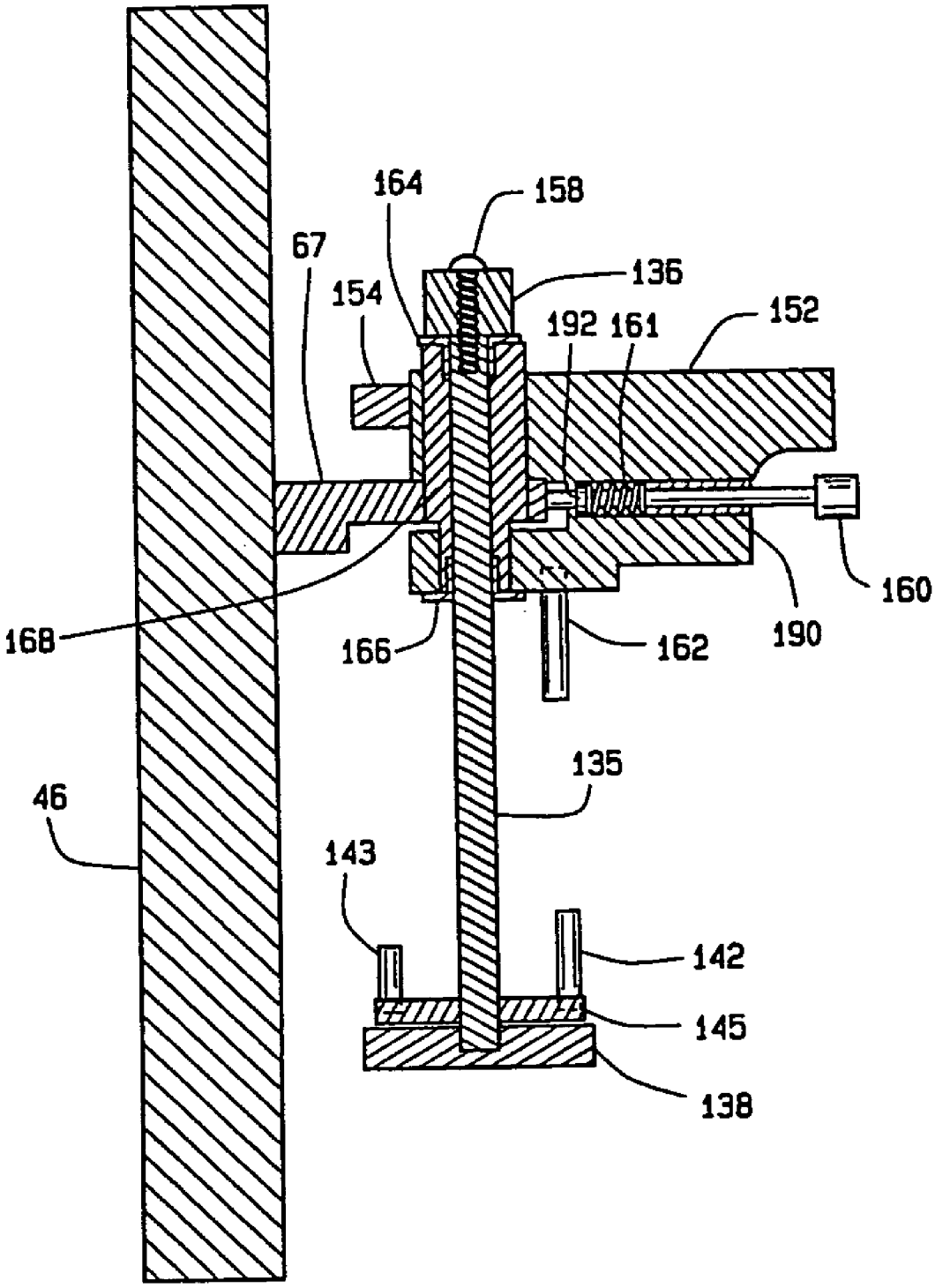
FIG. 22 is a section view along the line 22-22 of FIG. 19 of portions of the assembly system 68. In this view the slide arm is in the lower position.
Figure 23:
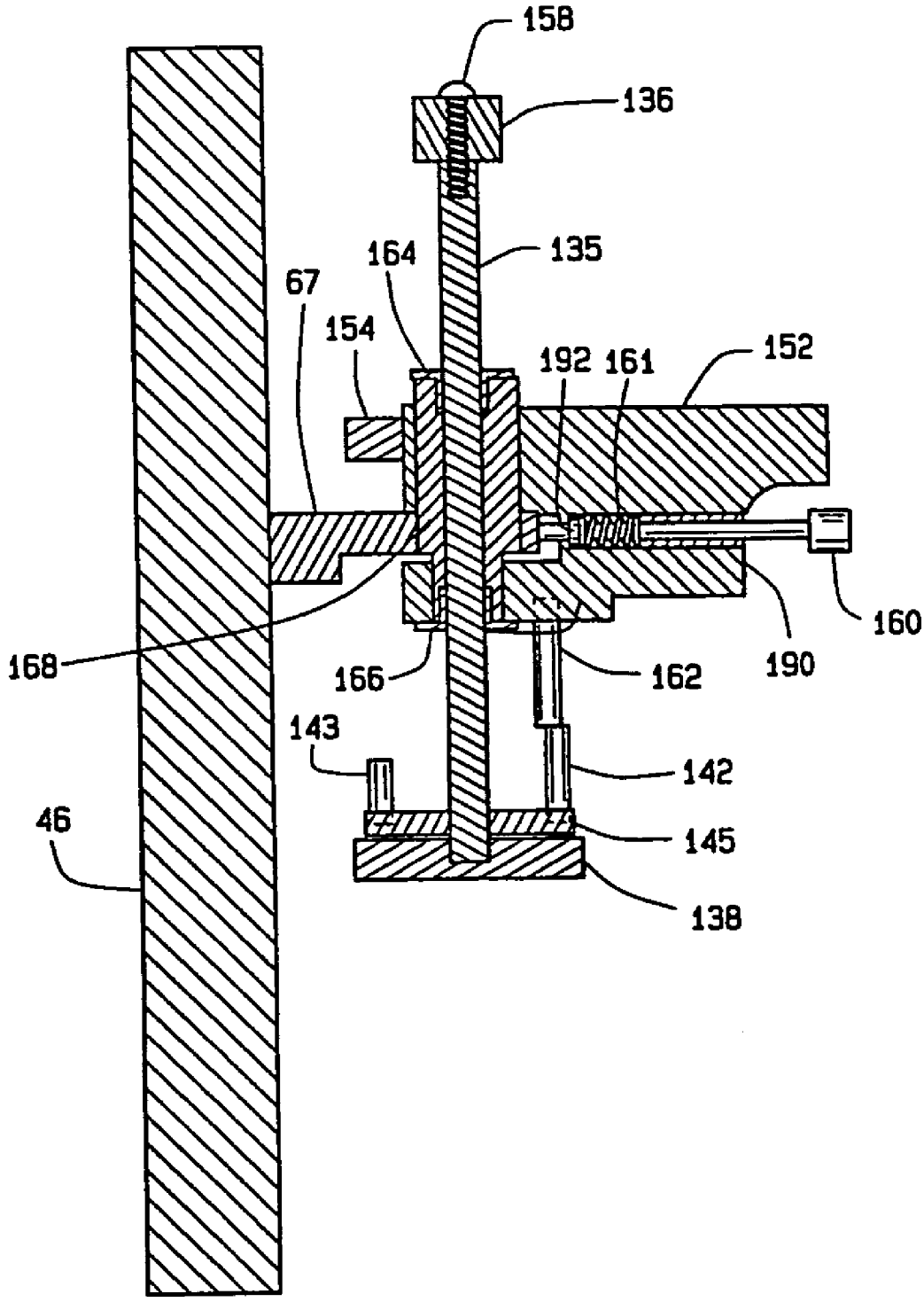
FIG. 23 is a section view along the line 22-22 of FIG. 19 except the slide arm is in the upper assemble position.
Figure 24:
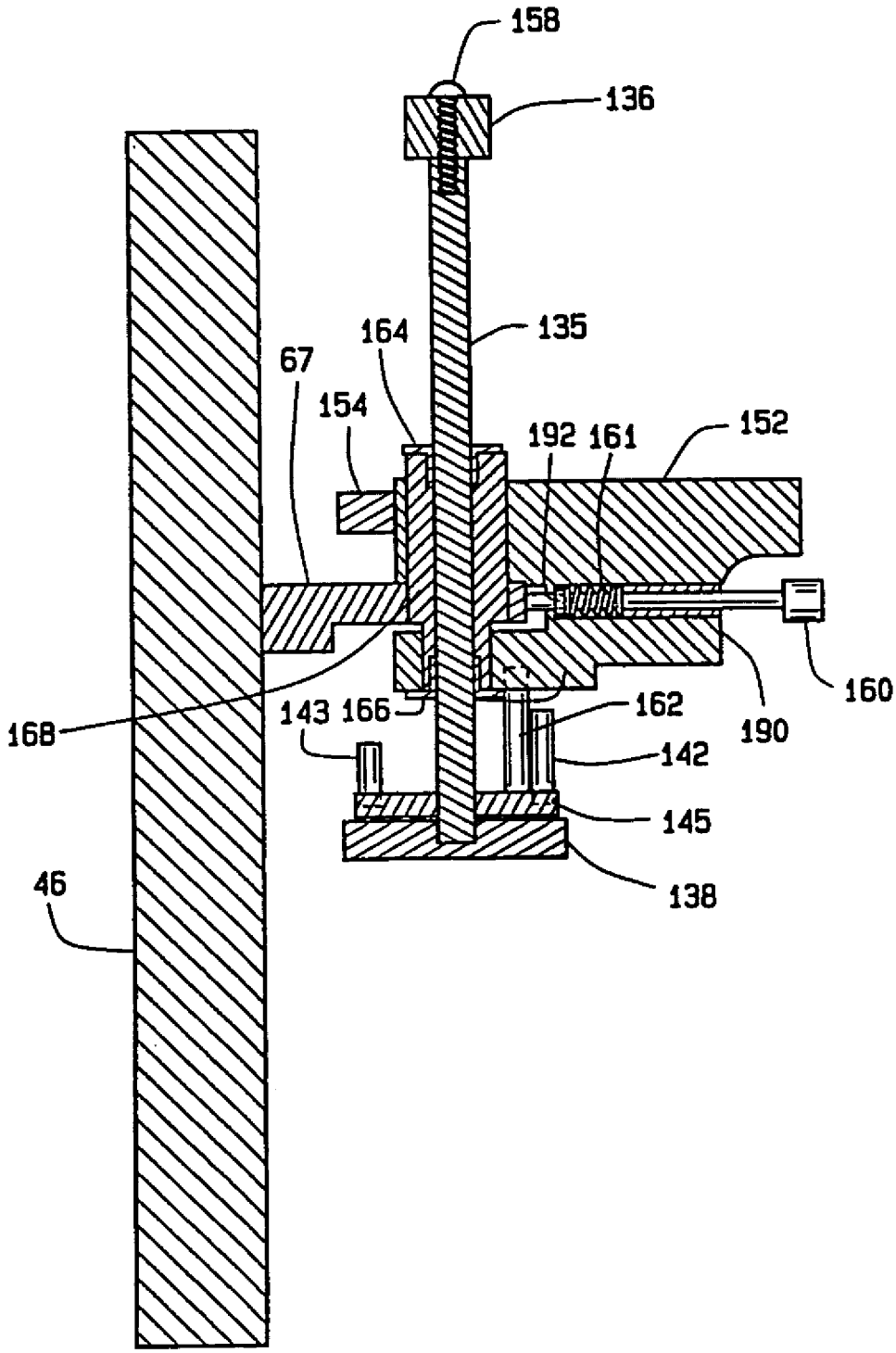
FIG. 24 is a section view along the line 24-24 of FIG. 20. In this view, the slide arm is in the upper eject position.

FIG. 22 is a section view along the line 22-22 of FIG. 19 of the assembly system 68. The assembly system includes the slide subassembly and the capsule stop subassembly 150. The capsule stop subassembly is best seen in plan view in FIGS. 19-21. The slide subassembly is better seen in FIGS. 22-24 as the subassembly moves through the various assembly steps. In FIG. 22, the slide arm 138 is in the lower position as shown in FIG. 7. The assembly/eject rod 140, better seen in FIG. 15 is likewise in the lower position. In FIG. 23, the slide arm is in the assemble position as better seen in FIG. 9. The assembly/ejection rod 140, better seen in FIG. 16 is also in the upper assemble position. In FIG. 24, the slide arm 138 is in the eject position as shown in FIG. 10. The assembly/eject rod 140, better seen in FIG. 18 is also in the eject position.

In FIG. 22, a screw 158 connects slide handle 136 to slide rod 135 which converts to slide arm 138. An upper bushing 164 and a lower bushing 166 are pressed fit into a sleeve 168. The sleeve is pressed to fit in a bore in the handle 152.

A position pin spring 160 is held in place in the handle 152 by a spring retainer 190. The spring retainer threadibly engages the capsule stop subassembly handle 152. The spring 161 surrounds a portion of the position pin 160. A spring stop 192 is mounted on the position pin 160. The spring 161 is captured between the spring retainer 190 and the spring stop 192. This arrangement gives the position pin 160 the ability to engage and disengage recesses in the shelf 67 as the capsule stop assembly handle 152 moves from the position of FIG. 19, to the other positions shown in FIGS. 20 and 21.

FIG. 23 is a section view along the line 22-22 of FIG. 19. The slide handle 136 and the slide arm 138 are in the upper assemble position as shown in FIG. 9. The assembly/eject rod 140 is in the upper assemble position as best seen in FIG. 16.

FIG. 24 is a section view along the line 24-24 of FIG. 20. In this view, the slide handle 136 and the slide arm 138 are in the upper eject position as shown in FIG. 10. The assembly/eject rod 140 is likewise in the upper eject position as best seen in FIG. 18.

FIG. 25 is a perspective of the pathway of the conductors 86 through the housing 34. In order shield operators, a z-shaped pathway 87 is formed in the shielding materials 56 and the back wall 36. The conductors 86 are placed in this z-shaped pathway.

The invention claimed is:

1. A method for dispensing radiopharmaceuticals from a source vial into a capsule having a cap and a bottom comprising:

placing a capsule bottom in a removable bottom capsule insert mounted on a pivot arm of a toggle assembly;

placing a capsule cap in a removable upper capsule insert mounted on an assembly system;

inputting a predetermined volume into an input device to control a predetermined volume of the radiopharmaceutical to be pumped from the source vial into the capsule through a delivery needle;

moving the pivot arm to a dispense position under the delivery needle and actuating the toggle assembly to move the pivot arm from a lower position to an upper position of the dispense position;

dispensing the predetermined volume of the radiopharmaceutical into the capsule bottom;

actuating the toggle assembly to move the pivot arm from the upper position to the lower position of the dispense position;

moving the pivot arm to an assembly position under the capsule cap and actuating the toggle assembly to move the pivot arm from the lower position to the upper position of the assembly position;

raising an assembly slide to mate the capsule bottom with the capsule cap and lowering the assembly slide;

opening a capsule stop of the assembly system; and raising the assembly slide to eject the completed capsule from the assembly system and lowering the assembly slide.

2. The method of claim 1 further including: pushing a pin against the delivery needle to release a final drop of radiopharmaceutical from the delivery needle into the capsule bottom.

3. A method for dispensing radiopharmaceuticals from a source vial into a capsule having a cap and a bottom comprising:

placing a source vial containing a radiopharmaceutical into a safe;

lowering a pick-up needle through a septum into the source vial;

placing a capsule bottom in a removable bottom capsule insert mounted on a pivot arm of a toggle assembly;

placing a capsule cap in a removable upper capsule insert mounted on an assembly system;

inputting a predetermined volume into an input device to control a predetermined volume of the radiopharmaceutical to be pumped from the source vial into the capsule through a delivery needle;

moving the pivot arm to a dispense position under the delivery needle and actuating the toggle assembly to move the pivot arm from a lower position to an upper position of the dispense position;

dispensing the predetermined volume of the radiopharmaceutical into the capsule bottom;

actuating the toggle assembly to move the pivot arm from the upper position to the lower position of the dispense position;

moving the pivot arm to an assembly position under the capsule cap and actuating the toggle assembly to move the pivot arm from the lower position to the upper position of the assembly position;

raising an assembly slide to mate the capsule bottom with the capsule cap and lowering the assembly slide;

opening a capsule stop of the assembly system; and raising the assembly slide to eject the completed capsule from the assembly system and lowering the assembly slide.

4. A method for dispensing radioiodine from a source vial into a capsule having a cap and a bottom comprising:

opening a door of a housing;

removing a lid from a tungsten safe;

placing a source vial containing a stock solution of radioiodine into the safe and placing the lid back on the safe;

lowering a pick-up needle through a septum into the stock solution of radioiodine;

closing the door of the housing;

placing a capsule bottom in a removable bottom capsule insert mounted on a pivot arm of a toggle assembly;

placing a capsule cap in a removable upper capsule insert mounted on an assembly system;

moving a capsule stop over the capsule cap to hold the capsule cap in place during the assembly process;

inputting a predetermined volume into an input device to control a predetermined volume of the radioiodinel to be pumped from the source vial into the capsule bottom through a delivery needle;

moving the pivot arm from a start position to a dispense position under the delivery needle and actuating the toggle assembly to move the pivot arm from a lower position to an upper position of the dispense position;

dispensing the predetermined volume of the stock solution of radioiodine into the capsule bottom;

actuating a push pin subassembly to cause a final drop of the radioiodine to fall from the delivery needle into the capsule bottom;

actuating the toggle assembly to move the pivot arm with the capsule bottom containing radioiodine from the upper position to the lower position of the dispense position;

moving the pivot arm with the capsule bottom filled with radioiodine from the dispense position to an assembly position under the capsule cap and actuating the toggle assembly to move the pivot arm with the capsule bottom containing radioiodine from the lower position to the upper position of the assembly position;

raising an assembly slide until a removable slide stop contacts the a stop pin to mate the capsule bottom with the capsule cap;

lowering the assembly slide;

opening the capsule stop;

raising the assembly slide to eject the completed capsule from the assembly system and then lowering the assembly slide;

actuating the toggle assembly to lower the pivot arm from the upper to the lower position of the assembly position; and moving the pivot arm to the start position.

5. A machine for dispensing radiopharmaceuticals from a source vial into a capsule having a cap and a bottom comprising:

a housing having an outer surface and an inner surface with shielding materials located between the outer and inner surfaces, the housing containing;

a safe sized and arranged to receive the source vial containing the radiopharmaceutical and a pump to transfer the radiopharmaceutical from the source vial;

an input device to control the pump and the volume of radiopharmaceutical transferred from the source vial to the capsule;

a conduit in fluid communication with the pump inside of the housing and in fluid communication with a delivery needle positioned outside the housing;

a toggle assembly mounted on the housing, the toggle assembly including a pivot arm, the arm holding a removable bottom capsule insert sized to hold the capsule bottom, the arm moving from a dispense position under the delivery needle to an assembly position, the toggle assembly moving the pivot arm and the bottom capsule insert from a lower to an upper position; and an assembly system mounted on the housing, the assembly system holding a removable upper capsule insert sized to hold the capsule cap and a slide to assemble and eject the assembled capsule from the assembly system after a dose of the radiopharmaceutical has been dispensed into the capsule bottom.

6. The apparatus of claim 5 wherein the delivery needle is a part of a delivery needle assembly including a push pin subassembly positioned adjacent the delivery needle, the push pin deflecting the delivery needle to cause a final drop of radiopharmaceutical to fall from the delivery needle into the capsule bottom.

7. The apparatus of claim 6 wherein the delivery needle assembly includes a cowling surrounding the delivery needle and a portion of the conduit feeding the delivery needle.

8. The apparatus of claim 7 wherein the cowling and the safe are formed from tungsten and the shielding materials are formed from lead.

9. The apparatus of claim 5 further including a movable capsule stop connected to the assembly system, the stop having a closed position to hold the capsule cap in the removable upper capsule insert during assembly of the capsule and an open position allowing ejection of the completed capsule after assembly.

10. The apparatus of claim 5 further including a pick-up needle assembly having a pick-up needle and positioned above the safe and the source vial, the pick-up needle assembly having an upper position with the pick-up needle not in contact with the source vial and a lower position with the pick-up needle inserted through a septum into the source vial.

11. The apparatus of claim 5 further including a set of removable upper capsule inserts, removable bottom capsule inserts and a set of removable slide stops, all sized to accommodate capsules of different sizes.

12. The apparatus of claim 5 wherein the housing includes a hinged door and a hollow interior chamber that contains the safe, the source vial, the pick-up needle assembly and the pump.

13. The apparatus of claim 5 wherein the radiopharmaceutical is radioiodine.

14. The apparatus of claim 5 wherein the weight including shielding materials is less than about 400 pounds.

15. An apparatus for dispensing a radiopharmaceutical from a source vial into a capsule having a cap and a bottom comprising:

means for housing a source vial containing the radiopharmaceutical;

means for pumping the radiopharmaceutical from the source vial to the capsule bottom;

means for sending signals to the pump means to pump a single dose of the radiopharmaceutical to means for delivering the dose into the capsule bottom;

means for conducting the radiopharmaceutical from the source vial to the delivery means;

means for assembling the capsule bottom containing a dose of the radiopharmaceutical with the capsule cap; and means for feeding capsule bottom to said means for delivering and for feeding filled capsule bottom to said means for assembling;

wherein said means for housing are shielding an operator from significant radiation exposure.

* * * * *